United States Patent [19]

Bell et al.

[11] Patent Number: 4,582,554

[45] Date of Patent: Apr. 15, 1986

[54] CARPET TILE PRODUCTION METHOD

[75] Inventors: Peter W. Bell; David S. Queen, both of Sanquhar; John B. Smith, Thornhill, all of Scotland

[73] Assignee: Sidlaw Industries Limited, Scotland

[21] Appl. No.: 637,725

[22] Filed: Aug. 6, 1984

Related U.S. Application Data

[63] Continuation of Ser. No. 368,688, Apr. 15, 1982, abandoned, which is a continuation of Ser. No. 163,699, Jun. 27, 1980, abandoned.

[30] Foreign Application Priority Data

Jul. 4, 1979 [GB] United Kingdom ..... 7923296

[51] Int. Cl.[4] ..... B32B 1/16; B32B 31/00; C09J 3/18; B03D 27/00

[52] U.S. Cl. ..... 156/247; 156/250; 156/298; 156/324; 156/334; 156/337; 428/95; 428/96; 428/290; 428/291

[58] Field of Search ..... 156/250, 231, 238, 289, 156/247, 327, 337, 344, 298, 246, 309.6, 324; 428/95, 96, 40, 290, 291, 489; D6/587, 582; D92/27

[56] References Cited

U.S. PATENT DOCUMENTS

| | | | |
|---|---|---|---|
| 1,182,414 | 5/1916 | Overburg | 156/241 |
| 1,694,523 | 12/1928 | White | 156/337 |
| 2,636,543 | 4/1953 | Groskopf | 156/337 |
| 3,583,889 | 6/1971 | Califano et al. | 156/235 |
| 3,919,018 | 11/1975 | Schroeder | 156/298 |
| 3,940,525 | 2/1976 | Ballard | 428/96 |
| 3,957,555 | 5/1976 | Bondi | 156/231 |
| 3,982,051 | 9/1976 | Taft et al. | 428/96 |
| 3,999,939 | 12/1976 | Psaar | 428/96 |
| 4,055,453 | 10/1977 | Tajima | 156/337 |
| 4,171,395 | 10/1979 | Tillotson | 428/95 |
| 4,199,634 | 4/1980 | Pole et al. | 428/96 |
| 4,201,812 | 5/1980 | Blanken et al. | 428/95 |
| 4,225,374 | 9/1980 | Kaufman | 156/247 |
| 4,228,208 | 10/1980 | Smith et al. | 428/95 |
| 4,242,393 | 12/1980 | Leupen | 428/95 |

FOREIGN PATENT DOCUMENTS

| | | | |
|---|---|---|---|
| 2329713 | 3/1975 | Fed. Rep. of Germany | 428/98 |
| 621040 | 4/1948 | United Kingdom . | |

*Primary Examiner*—Edward Kimlin
*Assistant Examiner*—Louis Falasco
*Attorney, Agent, or Firm*—Richard P. Crowley

[57] ABSTRACT

A method of backing carpeting material 19 with hot-melt compositions such as atactic polypropylene or bitumen comprises carefully doctoring selected thicknesses of the composition to the undersurface of the material 19 with the wear surface of the material uppermost. In one arrangement this is achieved using a lick roll arrangement 20 incorporating a doctor blade, cooling the backed product at cooling zones 28, 29 and applying the material to a nip formed by rollers 21. In another arrangement this is achieved by doctor box 16 applying the composition to a carrier 13, the carpeting material 19 then being laminated at roll 21 to the layer of composition, the laminate then being cooled before being stripped from the carrier 13. In a further arrangement the carrier is in the form of sheet material 15 which is supported by endless belt 13 and which is bonded into the hot-melt composition to become an integral part thereof.

9 Claims, 3 Drawing Figures

CARPET TILE PRODUCTION METHOD

This is a continuation application of Ser. No. 368,688, filed Apr. 15, 1982, which, in turn, is a continuation of Ser. No. 163,699, filed June 27, 1980, both now abandoned.

This invention relates to a method of and apparatus for the production of carpet tiles.

It is known to produce carpet tiles in the form of a pile surface bonded to a PVC backing and various methods and apparatus have been used in such production. These carpet tiles have proved extremely durable but because PVC is an oil-derived product the manufacturing costs of such carpet tiles have recently escalated and attention has been given to alternative backing compositions. There have been proposals previously to use atactic polypropylene (APP) as a backing composition but these proposals have not been of such a detailed nature as would permit production on a commercial basis and the technology developed for PVC backing is not directly applicable to APP because the physical chemistry of the two materials is entirely different.

We have now developed methods and apparatus using APP and/or other hot-melt compositions (e.g. bitumen with or without additives) to effect backing of carpeting material, which can be used on a commercial basis. According to one aspect of the present invention there is provided a method of manufacturing carpet tiles comprising the steps of (a) supporting an elongate carrier on a substantially flat support structure and moving said carrier successively through a backing station, a laminating station and a finishing station, (b) applying to said carrier at the backing station a hot-melt composition in liquid form at elevated temperature, (c) forming a laminate by laminating a layer of carpeting material to the exposed surface of said composition at said laminating station, and (d) cooling the laminate until said composition is solidified and cutting the laminate into tile form at said finishing station.

The hot-melt composition may be atactic polypropylene or bitumen (conveniently incorporating an elastomer such as 'Solprene' sold by Phillips Petroleum U.K. Ltd.). When APP is used the elongate carrier is preferably parted from the laminate prior to the latter being cut into tile form and so that the elongate carrier may be re-used. When bitumen is used the elongate carrier is preferably bonded into the hot-melt composition to form part of the laminate which is cut into tile form. Conveniently with this arrangement the carrier is itself releasably carried by an endless belt.

A layer of fabric material may be embedded within the hot-melt composition at the backing station, such material being a glass scrim or tissue or a foam fabric. In the case where the fabric material is glass scrim or tissue this may be applied to the hot-melt composition whilst the latter is in liquid form and the glass scrim or tissue allowed to sink into the liquid, a further layer of hot-melt composition in liquid form then being applied over the glass scrim or tissue prior to the lamination step. In the case where the fabric material is a foam fabric it is preferred that a further layer of hot-melt composition in liquid form be applied over the foam material prior to the lamination step. The hot-melt composition is preferably applied by means of a heated doctor blade and box in order to control the layer thickness and width.

The carpeting material which is used to form the laminate has a wear surface and an undersurface and the latter may be either in loomstate or treated prior to the lamination step. For example the treatment may be the application of a thin layer or film of liquid hot-melt composition at the laminating station and may comprise the application and curing or solidification of a layer of hot-melt composition. In the first example the laminating station preferably operates at a temperature where the hot-melt composition on the carrier is surface tacky but is not molten whereas, in the other example as is the case with loomstate carpeting material it is preferred that the hot-melt composition on the carrier is molten at the laminating station in such a manner that the carpeting material tends to sink into the hot-melt composition and become bonded. Where the carpeting material is treated at the laminating station it is preferred that this be effected by means of a heated lick roller/doctor blade arrangement in order to control the thickness of composition applied to the carpeting material and prevent strike through to the wear surface but this could also be achieved by the length of contact of the carpeting material with the lick roller or by a lick roller overfeed system or by tension control on the carpeting material or by a doctor blade directly operating on the undersurface of the carpeting material or by a combination of all these arrangements. Conveniently the lamination step is accomplished by means of a laminating roller which may either smooth the carpeting material onto the hot-melt composition or apply a degree of pressure to the hot-melt composition through the carpeting material.

The finishing station may incorporate one or more thermally-controlled zones at one or more of which a nip is formed between two rollers in order to improve the lamination quality of the laminate and the cutting process may be undertaken by a rotary disc and/or a die cutter operating sequentially.

The flat support structure for the elongate carrier may comprise a succession of plates or interlaced rotary discs and in the former case the plates may be thermally-controlled by means of electric elements or water circulation.

The carpeting material may take the form of very lightweight surface fabrics with high permeability properties, such as melded fabric of which 'Cambrelle' is one example (having a weight per square of 265 gm/sq.m) or tufted fabrics (of light medium or heavy weight) where there is a tendency for viscous backing materials to strike through to the wear surface.

According to another aspect of the present invention there is provided a method of manufacturing carpet tiles comprising the steps of feeding carpeting material with the wear surface uppermost through a backing station, and controllably applying hot-melt composition to the undersurface of the carpeting material in said backing station.

The application of hot-melt composition in the backing station may take place in one or more stages depending upon the desired thickness and the nature of the carpeting material. When two or more application stages are used it is preferred to have a cooling zone between adjacent application stages. After emerging from the backing station the backed carpeting material may be passed through a finishing station in which it is cooled and the exposed surface of the hot-melt treated either by embossing (in the case of APP) or by application of a protective backing (in the case of bitumen). The application of the hot-melt composition may be effected by means of a heated lick roller/doctor blade arrangement in order to control the thickness of composition applied whilst preventing strike through to the wear surface, but this could also be achieved by the length of contact of the carpeting material with the lick roller or by a doctor blade directly operating on the undersurface of the carpeting material or by a combination of all these arrangements.

A layer of fabric material as previously described may be embedded within the hot-melt composition at the backing station by applying the hot-melt composition in at least two application stages so that the fabric material is laid into and between layers of hot-melt composition at least one of which is sufficiently viscous to penetrate into the fabric material and bond with the other layer of hot-melt composition.

Embodiments of the present invention will now be described by way of example with reference to the accompanying schematic drawings, in which.

Figure 1:
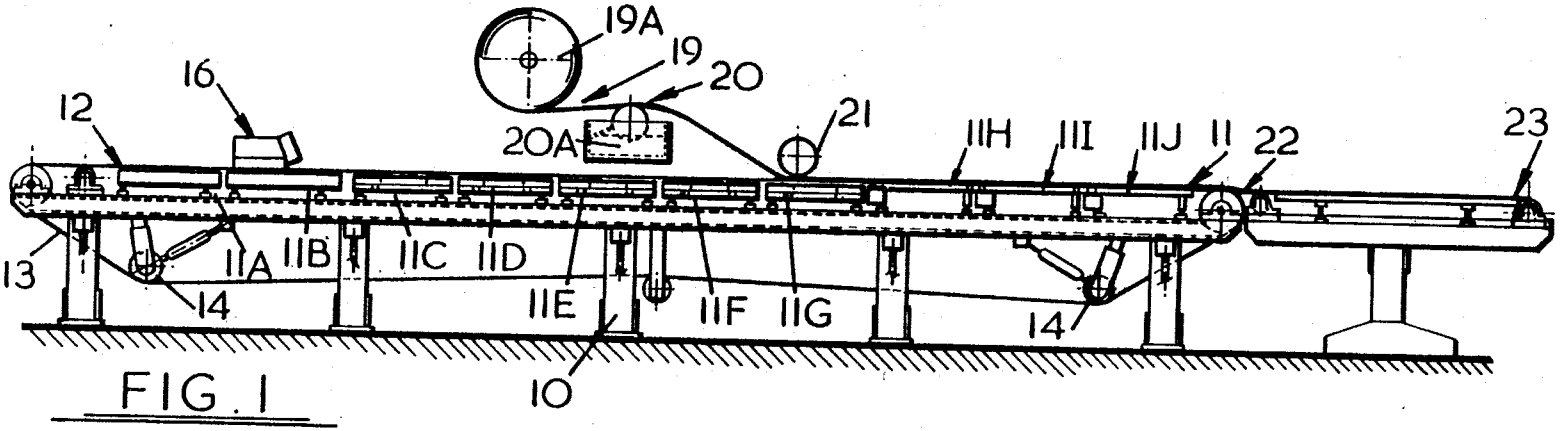
FIG. 1 is an elevational view of a first embodiment for manufacturing carpet tiles in accordance with the present invention.

In FIG. 1 a framework 10 carries a series of adjoining plates 11 which are arranged substantially end-to-end so that their upper surfaces 12 provide a substantially continuous flat support structure over which there is the upper run of an endless carrier belt 13, the lower run of which extends beneath the plates 11 and is tensioned by means of adjustable rollers 14. The upper run of the belt 13 is supported by the surface 12 of each plate 11. The belt 13 is made of a non-stick material or, at least, has a non-stick surface on to which the hot-melt composition is applied by means of a doctor box and blade 16.

The carpeting material 19 is unwound from a roll 19A passed over a lick roll and doctor blade arrangement 20 within a box 20A and laminated to the hot-melt composition by a laminating roller 21.

The laminate is removed from the upper run of the belt 13 at a roller 22 and fed over a run-out table 23 to a cooling chamber then to a tile-cutting mechanism (not shown).

The plates 11 are individually thermally controlled and in FIG. 1 plates 11B, C, D are maintained at temperatures, in the region of 10°-200° C., plates 11E, F and G are maintained at lower or intermediate temperatures, in the region of 10°-80° C., and plates 11H, I and J are maintained at sub-ambient temperatures, e.g. about 10° C. It will however be appreciated that because the plates 11 are thermally controlled on an individual basis there is provision for adjustment of individual temperatures to suitable levels for individual applications—i.e. depending upon the thickness of the hot-melt composition as determined by the doctor blades and the nature of the carpeting material. By way of example, all of the plates may be held at ambient temperature.

It will be noted that the plates 11 are located beneath the upper run of the belt 13 and therefore the thermal control of the substrate is applied through the belt 13.

The hot-melt composition applied by the doctor devices 16, 20 may be a bitumen, for example Shell Mexphalte having a penetration within the range 5-300. The bitumen may be modified by the use of fillers (e.g. limestone, calcium carbonate, barytes), and by the use of flame retardants. Such bitumens are liquid at temperatures within the range 80°-200° C. and it is preferred that they are applied at temperatures within the range 130°-180° C., 160° C. having been found convenient.

Alternatively the hot-melt composition applied by the doctor blades 16, 20 may be APP having 40 parts by weight APP and 60 parts by weight of fillers such as calcium carbonate, additives of antioxidant, colourant, hardeners and tackifying resins being less than 10% by volume. Such APP is liquid at temperatures in the range 140°-200° C. and is preferably applied at temperatures within the range 160°-190° C.

The doctor devices 16, 20 (both boxes and blades) are heated to maintain the hot-melt composition applied thereby liquid. Conveniently the boxes and blades and roll are held at a higher temperature (say 10° C. or 30° C.) than the liquid hot-melt composition supplied thereto. The composition applied by these devices may have any thickness but conveniently this is in the range 0.5-10 m.m.

The carpeting material 19 may be of any construction, conveniently having a weight per square in the range 6-80 ounces/sq. yard (200-2,800 gm/sq.m.).

The laminating roller 21 may or may not be heated but preferably is located in such a position that the hot-melt composition thereat is in the range 50°-180° C. Depending upon the nature of the material 19 and the temperature of the hot-melt composition at the roller 21 the roller 21 may exert a degree of pressure to squeeze the carpeting material into close contact with the composition without exerting such pressure as to cause the composition to flow laterally to any appreciable extent.

Figure 2:
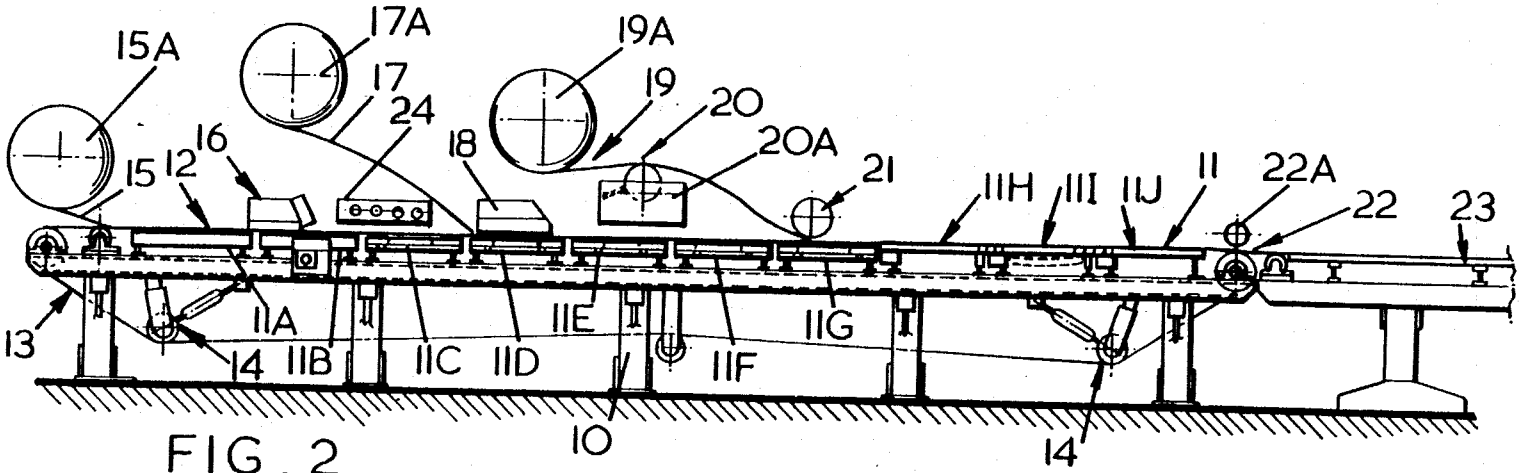
FIG. 2 is a view similar to that of FIG. 1 but showing additional optional components.

FIG. 2 is a modification of FIG. 1 in that all the components of FIG. 1 are present and in addition, prior to the lmination roller 21 but after doctor box and blade 16 there is provision to apply a fabric material 17 to the hot-melt composition. The material 17 may be either glass scrim or tissue to enhance the finished product dimensional stability, or a foam fabric to provide resilience and/or stability. An infra-red heater 24 may be used if required to ensure that the hot-melt composition is in liquid form where material 17 is applied to permit the material 17 to adhere firmly to the hot-melt composition, and if material 17 is glass scrim or tissue to permit it to sink into the hot-melt composition with penetration of the liquid through the scrim or tissue. A further heated doctor blade and box 18 may be used to apply an additional layer of hot-melt composition so that material 17 is contained within a body of such composition and carpeting material 19 is laminated thereto.

As a further alternative modification FIG. 2 illustrates the presence of an elongate carrier to the form of a backing sheet 15 which is initially laid onto belt 13 and bonded into the hot-melt composition applied by doctor blade and box 16. Backing sheet 15 may be a laminate of glass and polythene film (the film surface being applied directly to the belt 13) or glass-polythene film-glass, e.g. Polyglass, or heat set non-woven polyester fabric, e.g. Lutrador, or paper-polythene film (the film surface being applied directly to the belt 13) all of which are substantially resistant to the penetration therethrough of the hot liquid composition applied thereto by device 16. Because sheet 15 is used with this arrangement belt 13 may have a non-slip surface and a nip roller 22A co-operating with roll 22 allows the cooling and cutting stages of the process to be physically isolated from the backing and laminating stages. The sheet 15 is particularly useful in providing non-slip, non-fray and dimensional stability characteristics to the carpet tiles produced by the process. Additionally, where sheet 15 is used carrier belt 13 may be dispensed with because its principal function is undertaken by sheet 15, i.e. that of supporting the hot-melt composition whilst in non-solidified form in a substantially flat condition. This, of course, is achieved by the sheet 15 being supported on surfaces 12 of the plates 11. It could also be achieved by interleaved discs mounted on idler rollers.

The belt 13 and the materials 15, 17, 19 which are in roll form may be subjected to edge guidance systems in order that they are substantially in alignment before and after the laminating roll 21. The boxes 16, 18 may also be adjustable in size with movable side cheeks and an oversize doctor blade. Box 16 may be formed without a rear wall, having only side walls and a doctor blade.

Figure 3:
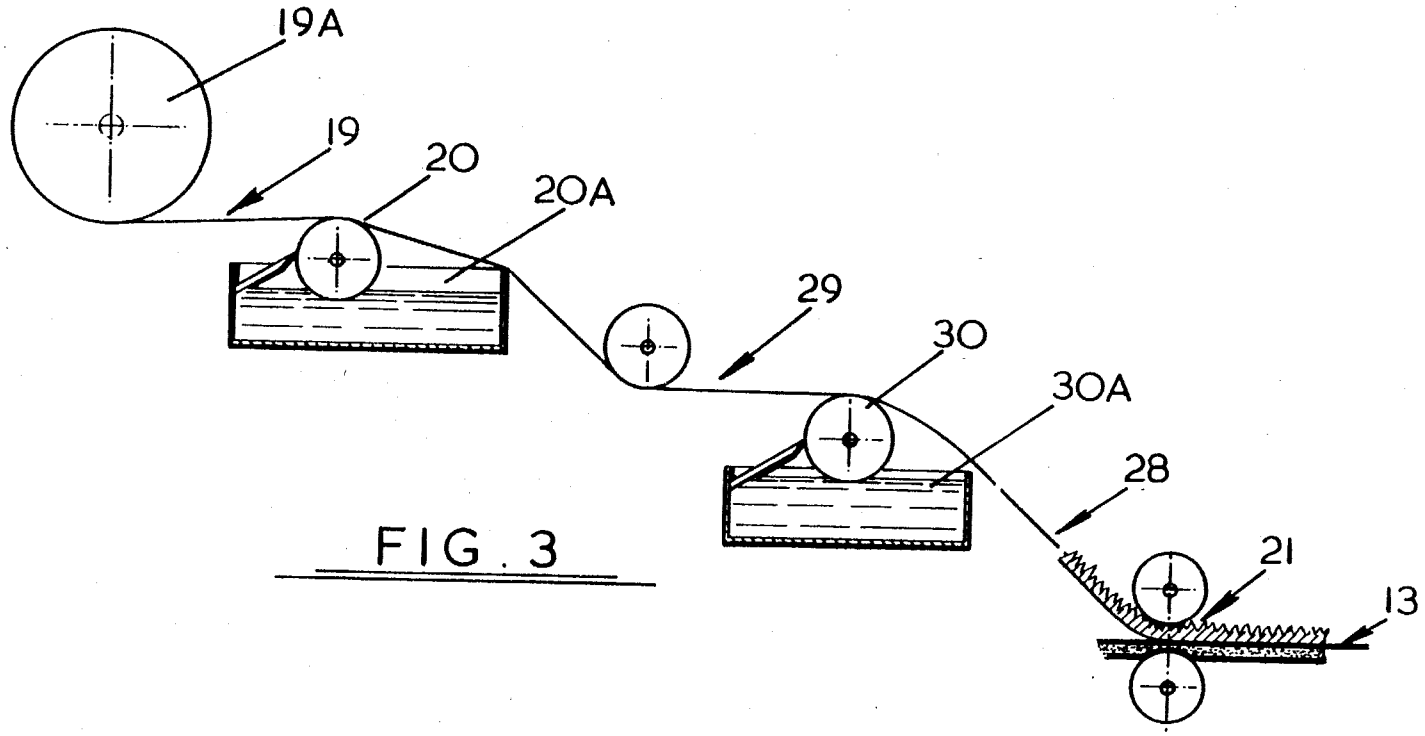
FIG. 3 schematically illustrates another embodiment.

In FIG. 3 there is shown the roller 19A of carpeting material 19 which is unwound and passed through a backing station comprising heated lick roll 20 with its associated doctor blade and box 20A, cooling zone 29, heated lick roll 30 with its associated doctor blade and box 30A, so that the hot-melt composition (either APP or bitumen) contained by these boxes is applied to the undersurface of the material 19 the wear surface of material 19 being uppermost at all times. On emerging from the backing station the backed material 19 is fed through nip rolls 21 at which point it may be laminated with a backing sheet corresponding to sheet 15 of FIG. 2 or the backed material 19 may simply be fed through the nip rolls 21 for the purpose of embossing the exposed surface of the hot-melt composition when the latter is APP. A cooling zone 28 is located between the backing station and the rolls 21 to obtain the correct viscosity level of the hot-melt composition at the rolls 21.

What is claimed is:

1. A method of manufacturing carpet tiles from a pliable web of carpeting material fabric having a wear surface and an undersurface in order to produce carpet tiles having shape and dimensional stability and low tolerance, said method comprising the steps of (a) supporting an elongate carrier web or on a substantially flat support structure and moving said carrier web successively through a backing station, a laminating station and a finishing station;

(b) successively applying onto said carrier web at said backing station a first fabric web, a first layer of a hot-melt composition in liquid form, a second fabric web, and a second layer of said hot-melt composition in liquid form, said first fabric web being substantially resistant to the penetration therethrough of the first layer of said hot-melt composition, the second fabric web being glass scrim or tissue and the first layer of said hot-melt composition being maintained in liquid form, by holding the backing station at a higher temperature than said hot-melt composition, to permit the second fabric web to sink into the first layer of said hot-melt composition with penetration of the liquid hot-melt composition through said second fabric web, said hot-melt composition being atactic polypropylene or having bitumen as the principal constituent and the thickness of hot-melt composition provided by said first and second layers being in the range of 0.5 to 10 mm, each of said first and second layers having its thickness determined and regulated by a respective doctor box and blade device maintained at a higher temperature than the liquid hot-melt composition supplied thereto;

(c) cooling the applied first and second layers between the backing station and the laminating station to reduce the temperature of said layers to below the temperature at which said hot-melt composition is in liquid form;

(d) precoating the undersurface of said carpeting material fabric at a precoating station with a continuous thin film of hot-melt in liquid form at elevated temperature while holding the precoating station at a higher temperature than said hot melt, said hot melt having the same principal constituent as said hot-melt composition forming said first and second layers;

(e) forming a laminated web at said laminating station by laminating the precoated undersurface of said carpeting material fabric to the exposed surface of said second layer of hot-melt composition, the wear surface of said carpeting material fabric being oriented upward;

(f) further cooling said laminated web until said hot-melt and hot-melt composition is solidified, optionally separating the laminated web from the carrier web and cutting said laminated web into tile form at said finishing station.

2. A method as set forth in claim 1, further including applying said laminated web during the further cooling step to a nip in order to improve the lamination quality of said laminated web.

3. A method as set forth in claim 1, wherein said first fabric web is a laminate of glass and polythene film or a heat set non-woven polyester fabric or a laminate of paper and polythene film.

4. A method as set forth in claim 1 wherein the support structure comprises a succession of thermally controlled plates or rotary discs.

5. A method as set forth in claim 1 wherein the carrier web comprises an endless belt having a surface which is non-stick to the hot-melt composition.

6. A method as set forth in claim 1 wherein the atactic polypropylene is liquid in the range of 140°–200° C. and the bitumen is liquid in the range of 80°–200° C.

7. The method as set forth in claim 1 wherein the doctor box and blade device are maintained at a temperature of about 10°–30° C. higher than the liquid hot-melt composition.

8. The method as set forth in claim 1 wherein the elongate carrier web is separated from the laminated web prior to cutting the laminated web into tile form.

9. The method as set forth in claim 1 which includes:

(a) employing the first fabric web as a supporting web and wherein the first fabric web is bonded to the first hot-melt composition to form a part of the laminated web and to provide nonslip, nonfray or dimensional stability characteristics to the laminated web; and (b) cutting the laminated web containing the bonded first fabric web into tile form.

* * * * *